US006371641B1

(12) United States Patent
Wilson, Jr.

(10) Patent No.: US 6,371,641 B1
(45) Date of Patent: Apr. 16, 2002

(54) COLLAPSIBLE SEAT AND CAPE

(75) Inventor: Louis A. Wilson, Jr., Jacksonville, FL (US)

(73) Assignee: Teddy Leonard, II., Jacksonville, FL (US)

( * ) Notice: Subject to any disclaimer, the term of this patent is extended or adjusted under 35 U.S.C. 154(b) by 0 days.

(21) Appl. No.: 09/729,663

(22) Filed: Nov. 6, 2000

(51) Int. Cl.[7] ..... A47C 7/62

(52) U.S. Cl. ..... 383/4; 206/278; 297/188.01; 297/188.03

(58) Field of Search ..... 206/278, 315.1, 206/579, 216; 297/188.01, 188.03, 188.12, 188.08; 383/4, 38

(56) References Cited

U.S. PATENT DOCUMENTS 2,865,433 A * 12/1958 Warner ..... 383/4
3,879,775 A * 4/1975 Iwata ..... 383/4
4,096,929 A * 6/1978 Frey et al. ..... 383/4
4,190,918 A * 3/1980 Harvell ..... 383/4
4,597,605 A * 7/1986 Gilbert ..... 297/188.01
4,822,309 A * 4/1989 Vandenberg ..... 297/188.01
4,843,662 A * 7/1989 Handelman ..... 297/188.01
4,854,637 A * 8/1989 McCree ..... 297/188.01
5,240,330 A * 8/1993 Thompson ..... 383/4
5,573,288 A * 11/1996 Raffensperger ..... 297/188.12
5,927,575 A * 7/1999 Gatling ..... 224/153
5,938,336 A * 8/1999 King ..... 383/4

* cited by examiner

*Primary Examiner*—Jim Foster
(74) *Attorney, Agent, or Firm*—Arthur G. Yeager

(57) ABSTRACT

This invention is a portable container resembling a large purse or a small piece of luggage that might be carried by a person to transport any of a variety of portable items to an outdoor sporting event. The container or bag has a flexible strap to allow the the bag to be carried by hand or to be slung over the shoulder. The bag has two identical internal pockets that extend across the full length and width of the bag and are openable by a zipper or other quick opening closure. Internally of one pocket is a block of a foamed elastomer that completely fills that compartment and thereby becomes a comfortable pillow upon which the bag owner sits the other pocket contains a protective cape that is heavy enough to keep the wearer warm and sufficiently water resistant to shield the wearer from rain or snow. Preferably, the bag will be printed or otherwise illustrated with the logo of a sports team so as to identify the owner as a fan of that team.

6 Claims, 2 Drawing Sheets

COLLAPSIBLE SEAT AND CAPE

(b) CROSS-REFERENCE TO RELATED APPLICATIONS

Not Applicable

(c) STATEMENT REGARDING FEDERALLY SPONSORED RESEARCH

Not Applicable

(d) BACKGROUND OF THE INVENTION (1) Field of the Invention

This invention relates to a small portable bag to be carried by a spectator attending an outdoor sporting event, and more particularly, it relates to such a bag containing a pillow and a poncho-cape in separate parallel compartments.

(2) Description of the Invention

The prior art contains descriptions of portable bags that contain a pillow to sit on wherever the owner of the bag wishes. Examples of this art include U.S. Pat. No. 2,865,433 issued to S. T. Warner and U.S. Pat. No. 4,783,120 issued to R. J. Kiechlin. Other portions of the prior art include backpacks that contain an article to protect a hiker against the rain, generally a coat or cape of rainproof material. Typical of such art are U.S. Pat. No. 4,103,377 to Mayer and Smart; U.S. Pat. No. 4,389,735 to McLaughlin; U.S. Pat. No. 4,563,777 to Park; U.S. Pat. No. 5,165,111 to Lieberman; and U.S. Pat. No. 5,526,969 to Greenberger.

(e) BRIEF SUMMARY OF THE INVENTION

The present invention is a small portable bag that might be carried by a spectator attending a sports event, such as a football game, a soccer match, a baseball game, or a track and field event. The bag is designed in a rectilinear shape, square in cross-section (appx. 12–16 in. square) and about 4–6 in. thick. The interior space is divided into two substantially equal pockets having the same square cross-section mentioned above, and each about 2–3 inches thick. These two interior pockets are closed by any convenient quick-opening means, preferably by two zippers or by two fabric hook-and-loop fasteners(better known as VELCRO fasteners). One of these interior pockets encloses a pillow that fills the entire pocket while the other pocket contains a folded poncho-cape or parka-cape that is suitable to keep the owner of the bag dry in the event of rain or snow. Of course, the owner may decide to carry other items in either pocket, e.g. food, drink, clothing, or the like.

(f) BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

(g) DETAILED DESCRIPTION OF THE INVENTION

This invention relates to a handbag or a small piece of luggage that might be carried to an outdoor sporting event. The bag, when the interior is filled, has a rectangular prismatic outside shape and has two substantially similar inside spaces that each comprise about half of the space totally enclosed by the outside surfaces of the bag.

Figure 1:
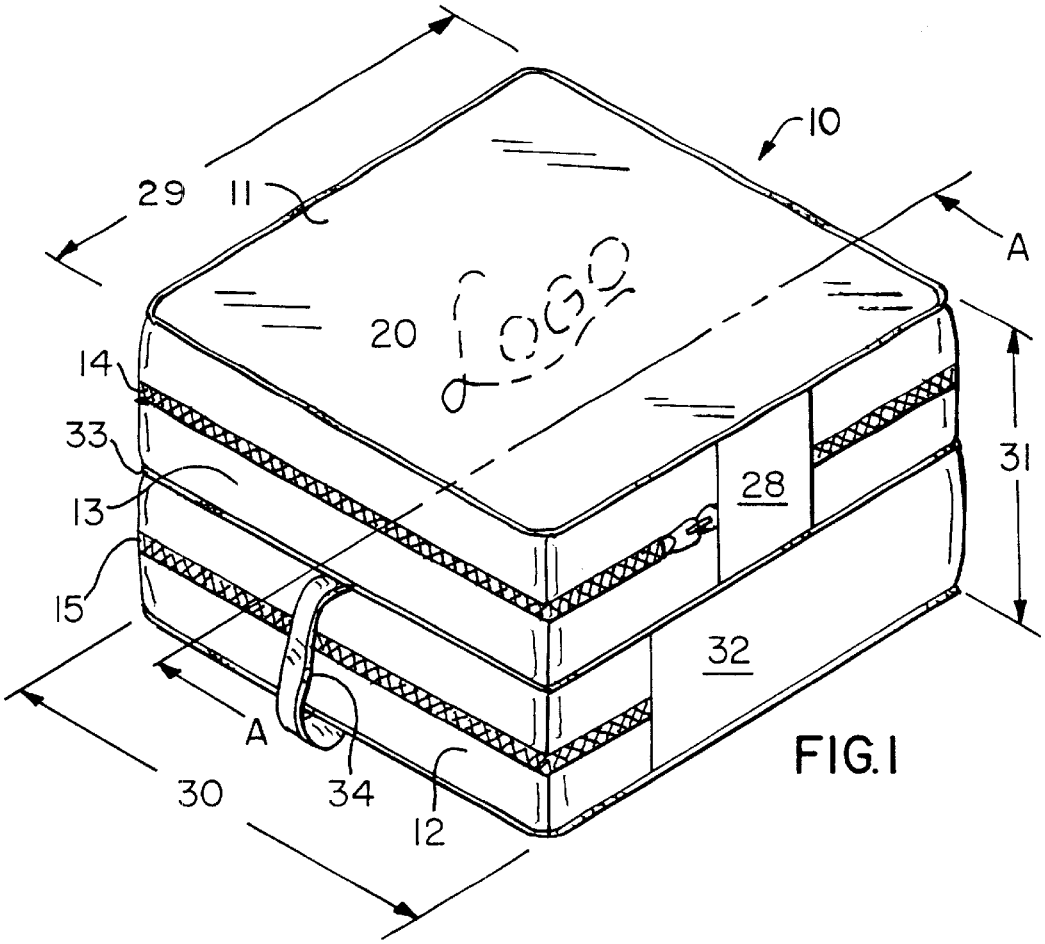
FIG. 1 is perspective view of the closed portable bag of this invention.
Figure 2:
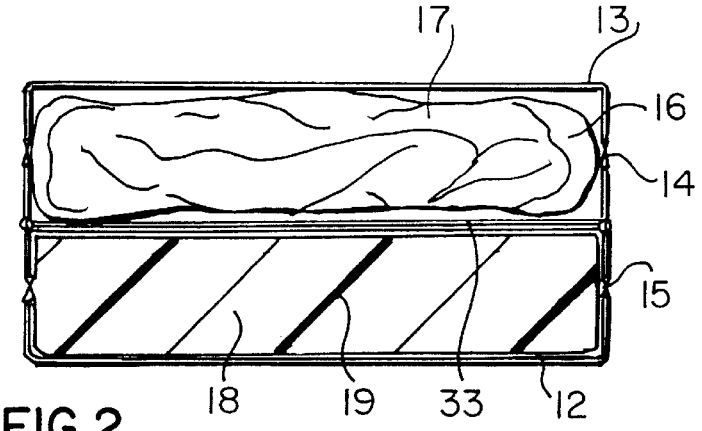
FIG. 2 is a cross-sectional view of the closed portable bag of FIG. 1, the view being taken at A—A of FIG. 1 to show two interior pockets, one of which holds a folded poncho-cape or parka-cape and the other of which holds a block-shaped pillow.

FIGS. 1 and 2 of the attached drawings are intended to graphically represent the bag. The bag 10 is a rectangular block-shaped container when the internal spaces 12 and 13 are filled. A central horizontal dividing wall 33 separates the two internal spaces 12 and 13 comprising the lower and the upper halves respectively of the total internal space of bag 10. Two zippers 15 and 14 are positioned to open and close the lower and upper halves 12 and 13 of bag 10 so as to permit halves 12 and 13 to be filled with or emptied of whatever the owner of bag 10 wishes. There are suitable connecting strips or panels 28 and/or 32 to make the use of bag 10 easy to manipulate when opening or closing zippers 14 and 15. Generally it is considered a good design to incorporate two strips or panels 28 or 32 placed on opposite sides of bag 10 to provide stability for each zipper 14 and 15 to open or close each bag half 13 and 12, respectively. There also is included a carrying loop 34 attached to the outside of bag 10, preferably to the outside of lower half 12. The bag 10 may have any convenient size although the preferred size is about 15–18 in. square and about 5–6 in. deep. Preferably the bag is made of a synthetic fiber material, e.g. nylon, polyolefin, polyacrylic, polyester, or the like.

The bag in the drawings shows a logo 20 on the top outside surface. One of the principal uses of the bag of this invention is at a football game, and it is appropriate to advertise who the owner of the bag favors to win by applying a team logo to the bag; such as the fanciful design 20 shown in FIG. 1. It is expected that the purchaser will choose a logo that represents the home team or some favorite from the past, but there may be other influences that cause the purchaser to choose some other logo.

Figure 3:
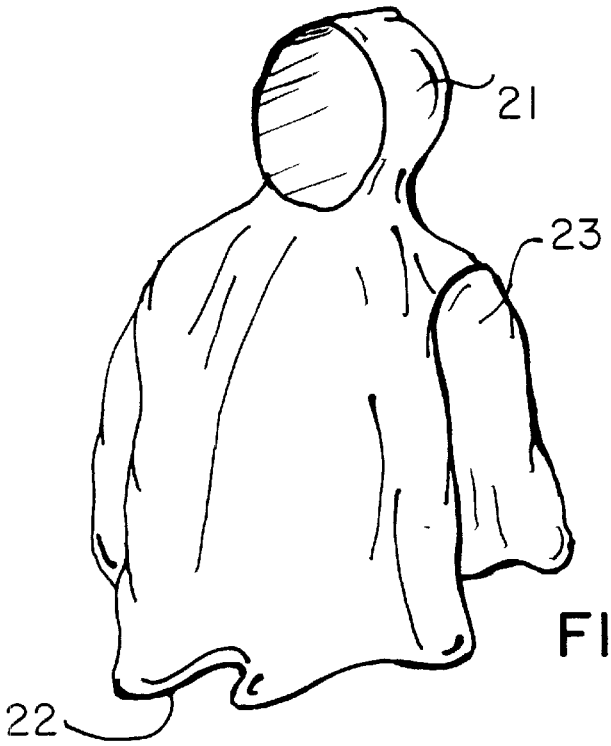
FIG. 3 is a perspective view of a person wearing the poncho-cape or parka-cape mentioned in the description above of FIG. 2.
Figure 4:
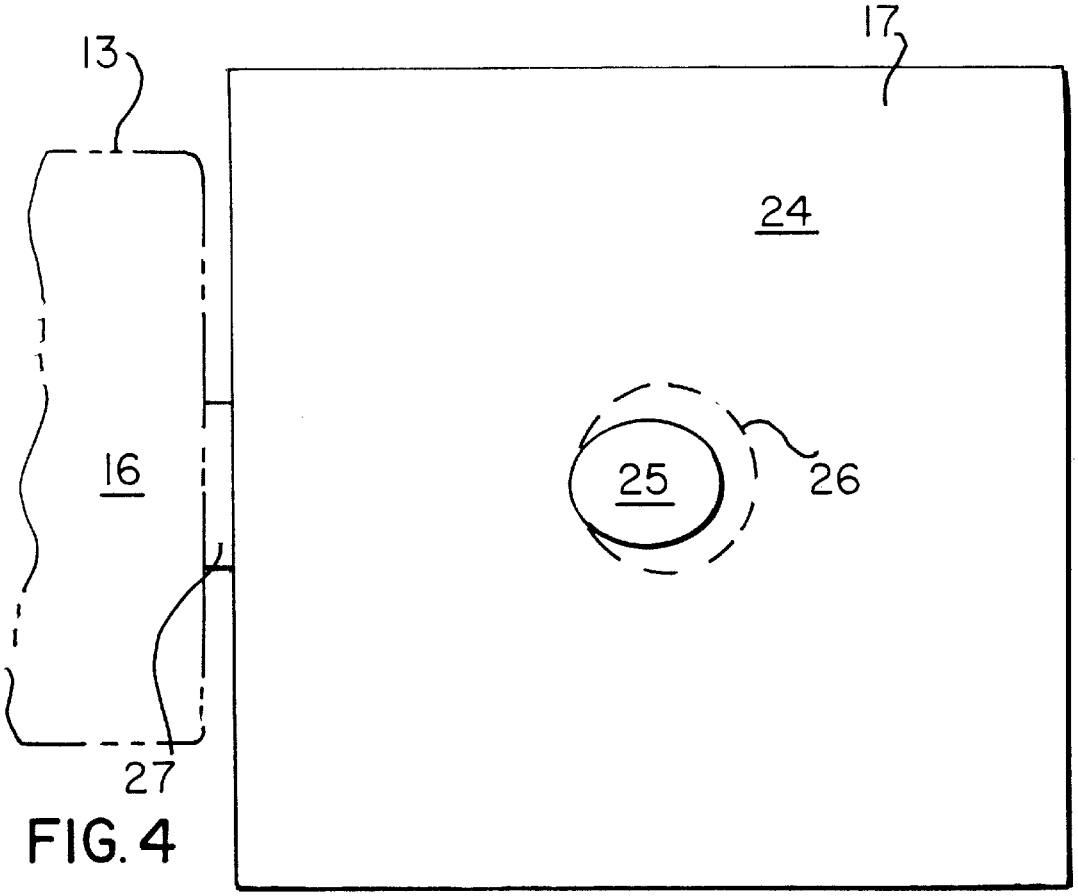
FIG. 4 is a top plan view of the poncho-cape or parka-cape of FIG. 2 spread out on a flat horizontal surface.

FIG. 3 is a perspective view of a person wearing the parka-cape or poncho-cape which is the preferred article stored in the top half 13 of bag 10. This cape (shown as item 17 in FIG. 2) is essentially a square piece of fabric that may be rubberized to make it essentially impervious to water. It should be thin enough so as to be comfortable and easy to wear and not too bulky to carry in pocket 13. The cape should be easily foldable and condensible into the size to fit readily into pocket 13 of the bag 10 of this invention. FIG. 3 shows the essentials of the design of parka-cape 17. There is a central headhole 25 in the center of the parka and enough extra head covering 26 to drape over the head of the wearer without covering his or her eyes. The remainder of the parka skirt forms a front and back that hang from arm and shoulder openings 23. An alternative embodiment includes a connecting strip 27 which positively attaches parka skirt 24 to the inside of pocket 13 in bag 10. This feature may be favored by some who are fearful of losing parka 17 unless it is physically connected to bag 10.

The lower portion of bag 10 comprising lower pocket or lower half 12 is filled with a block pillow 19 of a foamed synthetic polymeric elastomer or a foamed rubber or a feathery pillow. The pillow in this lower pocket 12 is for the comfort of the person sitting on this bag 10. Foamed elastomeric pillows are preferred because of their structural stability and oxidation resistance, but any type of resilient filling may be used to suit the user. There are many types of foamed elastomeric materials that are suitable and do not differ widely in their properties and, therefore, may be used in this invention advantageously. Among these elastomeric materials are polyolefins, such as polyethylene, polypropylene, polybutenes, and other elastomeric materials that serve well as modern substitutes for foamed rubber.

While the invention has been described with respect to certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States of America is:

1. A fabric bag adapted for use as a seat pillow by a spectator attending an outdoor sporting event; said bag having a totally encloseable interior comprising two contiguous parallel horizontal pockets, one of which is filled with a foamed elastomeric pillow, and the other of which encloses a folded poncho-cape or parka-cape, each of said pockets being closeable and openable by means of a separate quick-acting fastener.

2. The fabric bag of claim 1 wherein said fastener is a zipper.

3. The fabric bag of claim 1 wherein said fastener is a hook-and-loop fabric fastener.

4. The fabric bag of claim 1 wherein the said poncho-cape or parka-cape is securely fastened along its lower perimeter to the inside of the pocket in which it is enclosed when not in use.

5. The fabric bag of claim 1 which additionally includes on the outside of one of said pockets the insignia of a notorious sports team.

6. The fabric bag of claim 1 wherein the said bag is water-resistant.

* * * * *